United States Patent [19]

Smith et al.

[11] Patent Number: 4,782,979

[45] Date of Patent: Nov. 8, 1988

[54] APPARATUS FOR DISPENSING A SUCCESSION OF CONICAL OBJECTS

[75] Inventors: Alan Smith, Accrington; George K. Butler, Preston, both of England

[73] Assignee: Hollingsworth UK (Ltd.), Accrington, England

[21] Appl. No.: 43,891

[22] Filed: Apr. 16, 1987

[30] Foreign Application Priority Data

May 23, 1986 [GB] United Kingdom ..... 8612637

[51] Int. Cl.[4] ..... B65G 59/06; B65H 3/44

[52] U.S. Cl. ..... 221/6; 221/114; 221/236; 221/251; 221/258; 211/59.2; 211/59.4; 312/35; 414/97

[58] Field of Search ..... 221/6, 112, 114, 115, 221/116, 118, 123, 124, 129, 131, 200, 204, 251, 258, 236; 312/35, 45, 72; 414/97; 211/59.2, 59.4; 193/1, 2, 32, DIG. 2

[56] References Cited

U.S. PATENT DOCUMENTS

| | | | |
|---|---|---|---|
| 2,197,634 | 4/1940 | Du Grenier | 221/114 |
| 2,265,696 | 12/1941 | Mullins | 221/112 |
| 2,428,594 | 10/1947 | Thomas et al. | 193/2 R |
| 2,586,351 | 2/1952 | Larimore | 221/6 X |
| 3,036,730 | 5/1962 | Newberry | 221/114 X |
| 3,095,114 | 6/1963 | Tobias | 221/114 |
| 3,370,398 | 2/1968 | Laager | 193/32 X |
| 3,837,528 | 9/1974 | Rakucewicz | 221/114 |

FOREIGN PATENT DOCUMENTS

| | | | |
|---|---|---|---|
| 632070 | 11/1963 | Belgium | 211/59.2 |
| 0168935 | 1/1986 | European Pat. Off. . | |
| 2144455 | 3/1985 | United Kingdom . | |

*Primary Examiner*—Joseph J. Rolla
*Assistant Examiner*—Edward S. Ammeen
*Attorney, Agent, or Firm*—Cort Flint

[57] ABSTRACT

A device for dispensing conical objects to form a stream of generally horizontal side-by-side conical objects with alternate conical objects having one orientation and intervening conical objects having the reversed orientation. The stacks having a first orientation have release cams driven from a common cam shaft while the intervening stacks have release cams driven from a common cam shaft, the timing of the two cam shafts being such that the conical objects are released successively starting from stack and ending at stack.

15 Claims, 4 Drawing Sheets

APPARATUS FOR DISPENSING A SUCCESSION OF CONICAL OBJECTS

FIELD OF THE INVENTION

The present invention is concerned with dispensing conical objects in a stream which can be fed from one location to another by transverse movement of the conical objects. For example, the apparatus has application in the handling of conical winding tubes for textile spinning and winding.

PRIOR ART

In GB-A-No. 2,144,455 and EP-A-No. 0 168 935 there is disclosure of feeding a succession of conical winding tubes arranged such that the orientation of alternate tubes in the succession is identical and the orientation of the intervening tubes in the sucession is reversed. In other words the narrow end of one tube sits next to the wide end of the two adjacent tubes along the stream.

In order to deliver concial tubes into this pre-determined stream it has in the past been necessary for an operator to place tubes next to one another in the appropriate orientation in a container or on a delivery chute.

OBJECT OF THE INVENTION

It is an object of the present invention to provide for automactic dispensing of a stream of conical objects with alternate orientation of the objects in the stream.

SUMMARY OF THE INVENTION

Accordingly, the present invention provides a device for dispensing conical objects characterised in that it comprises at least two side-by-side stacks having a cross-section of tapering form to accommodate conical objects in a horizontal or inclined orientation, and means for releasing a concial object from one of the stacks to land on a collecting surface adjacent to a conical object from the next adjacent stack having the reverse orientation, whereby the conical objects can be delivered by lateral movement along the collecting surface before release of the next conical objects in a sequence which follows on from the first-released conical objects so that the delivered stream of conical objects has each alternate conical object of the same orientation and the intervening conical objects of reversed orientation.

BRIEF DESCRIPTION OF THE DRAWINGS

In order that the present invention may more readily be understood the following description is given, merely by way of example, with reference to the accompanying drawings in which.

DESCRIPTION OF THE PREFERRED EMBODIMENTS

Figure 1:
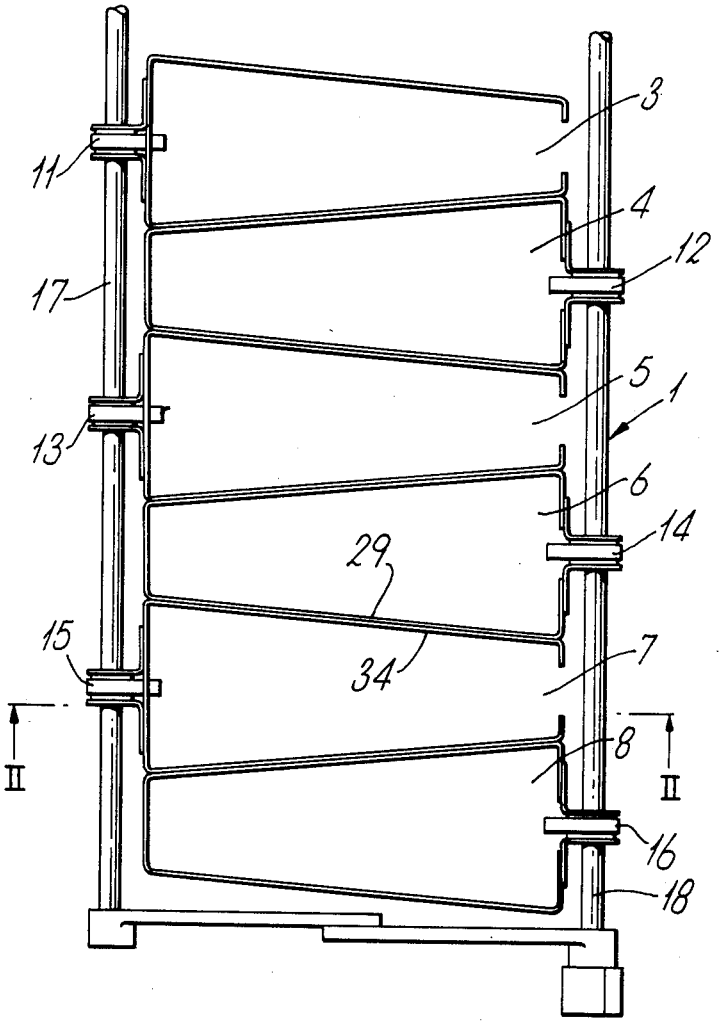
FIG. 1 is a top plan view of one embodiment of dispensing apparatus for conical objects, in accordance with the present invention.

The plan view of FIG. 1 shows that the dispensing apparatus 1 comprises a succession of stacks, 4, 6, 8 for conical objects, such as textile yarn winding tubes, having their wider ends to the right hand side of the apparatus and interspaced by an equal number of alternate stacks 3, 5 and 7 for conical winding tubes having the reverse orientation. It will be appreciated that references to conical objects herein include frusto-conical objects.

Each of the first series of stacks has a respective release cam 12, 14 and 16 mounted so as to be driven by a cam shaft 18, whereas the alternate stack has a series of release cams 11, 13 and 15 driven by a cam shaft 17.

Extending beneath the apparatus is a chute 19 (FIG. 2) for receiving the dispensed conical tubes. The chute 19 is generally in the form of a trough having steeply inclined side walls 20 and 21 and a generally flat floor 22 on which a fin 23 is provided to help to maintain the axes of rotation of tubes in the chute 19 substantially horizontal.

If desired, the chute 19 may include a driven mechanism for unsticking conical tubes, in accordance with our EP-A-No. 0 168 935.

Figure 2:
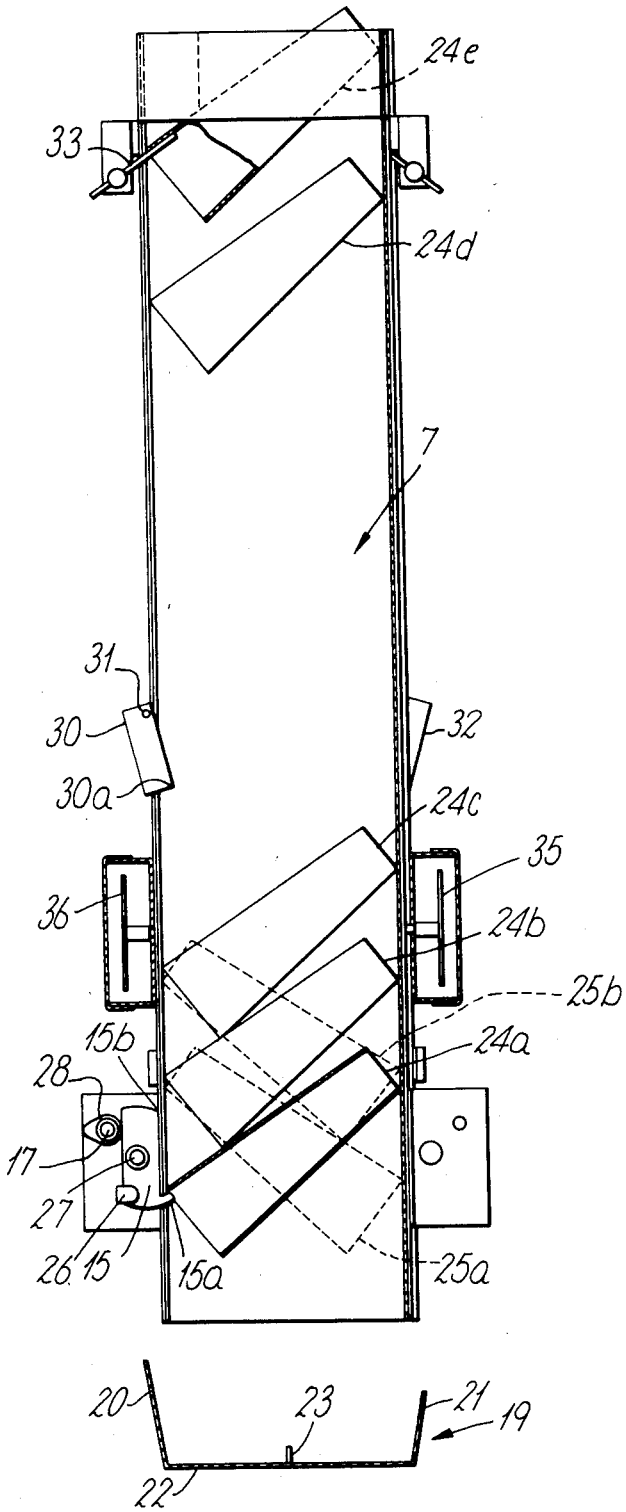
FIG. 2 is a sectional view taken on the line II—II of FIG. 1.

FIG. 2 shows schematically one stack 7 having its tubes 24*a*, 24*b*, 24*c*, 24*d* and 24*e* all contained within the stack in an orientation which obliges them to remain upwardly inclined. The tubes 25*a* and 25*b* at the bottom of the next adjacent stack 6 can be seen in dotted lines in FIG. 2.

As can be seen in FIG. 2, the release cam 15 of the stack 7 has a spring-biasing shoe 26 urging the tooth 15*a* of the cam into the stack 7; to the other side of the pivot spindle 27 of the cam 15 is a drive cam 28 mounted on the cam shaft 17. Thus, during rotation of the cam shaft 17, at an appropriate instant when release of a tube from the stack 7 is requred, the drive cam 28 rocks the release cam 15 in the clockwise direction far enough to retract the cam tooth 15*a* to allow the bottom tube 24*a* in the stack 7 to be released onto the chute 19, but simultaneously the top corner 15*b* of the release cam enters the stack 7 to hold up the next adjacent tube 24*b*. Thus only the bottom tube 24*a* is allowed to drop.

FIG. 2 also shows a tube brake 30 of the stack 7, comprising a rectangular plate freely suspended about a pivot axis 31 at one corner, and arranged so that another corner 30*a* of the plate projects into the stack 7. FIG. 2 also shows the corresponding brake 32 of the next adjacent stack 6 (FIG. 1).

FIG. 2 illustrates the configuration of stack 7 immediately after the stack has been completely filled, but omitting several of the conical tubes between tubes 24*c* and 24*d*. Naturally, as tube 24*a* and the adjacent tubes 24*b* and 24*c* . . . etc. are consumed from the bottom of the stack 7 the tube 24*d* will descend until eventually it, too, becomes held by the release cam tooth 15*a*.

In order to load the device, an operator will place an uppermost tube 24*e* in the top of each stack to be retained by the retaining fingers 33. When all stacks are thus loaded with a tube 24*e* the operator actuates clockwise pivoting of the retaining fingers 33 at the top of the stacks to release the tubes 24*e* ready for the next loading cycle.

In order to release the tube 24*e* to fall onto tube 24*d*, the retaining fingers 33 may be connected to a common actuator so as to be rotated simultaneously in the clockwise direction through an angle of at least 120° whereupon the wider end of the top tubes 24e will be released.

Reference to FIG. 1 will show that the stack 7, in this case defined by a sheet metal member 34 which is positioned in side-by-side contacting arrangement with a corresponding bent sheet 29 forming the stack 6, has a cross-section which matches that of the line of tubes in the stack 7. In fact, the conicity of the tubes is not identical to the cross-sectional taper of the stack 7 because the tubes will always retain their inclined orientation and will therefore present a fore-shortened vertical projection which will match the cross-section of the member 34. Thus the angle of taper of the member 34 will be slightly greater than the conicity angle of the tubes and the length of the longitudinal axis of symmetry of the stack cross-section will be shorter than the length that vertical projection of any one of the tubes, for example 24e. In this way, as the top tube 24e is released it will retain its inclined orientation because the width of the stack as viewed in FIG. 2 is insufficient to allow the tube to become horizontal, let alone to adopt an oppositely inclined orientation.

Near the bottom of the stack is a radiation emitter 35, emitting optionally modulated radiation, preferably infra-red radiation, and a radiation receiver 36 responsive to the radiation emitted by the emitter 35 and able, therefore, to indicate whether a tube 24c is in place between the emitter 35 and the receiver 36. When the receiver 36 supplies a controller (not shown) with a "no-tube-present" signal a warning is given to the operator to replenish the stack of tubes.

In practice, there will be an emitter and receiver pair 35, 36 associated with each of the respective stacks 3, 4, 5, 6, 7 and 8 so that when any one of those emitter-receiver pairs gives a "no-tube-present" signal the warning will be given to alert the operator to replenish the stacks.

To ensure that the received signal is indicative of radiation from the associated emitter 35 and not from an adjacent emitter, the emitters 35 and receivers 36 may be switched so that each pair is active alone when the emitters and receivers of the other columns, in particular the immediately adjacent columns, are inactive.

Because of the orientation of the cross-sections of the stacks 3–8, the operator can only place the tubes in a given orientation and, furthermore, because the retaining fingers 33 are all biased towards the position shown for them in FIG. 2 the top tube (such as tube 24e in stack 7) must be placed in the correct inclined orientation before it can be released to decend through the stack and to land on the next adjacent tube down the stack.

In order to help to maintain the orientation of the tubes in the stack by preventing the narrow end of the falling tube from sticking and causing the tube to adopt a vertical orientation, the inertia brake 30 is pushed aside by the wider end of the falling tube and this helps to retard that wider end to maintain the inclined orientation of the tube (matching the foreshortened cross-section of the stack 7, referred to above).

In practice the cam shafts 17 and 18 (FIG. 1) are driven from a common drive source (not shown) and the timing of the drive cams 28 fixed to those cam shafts is such that the stack, in this case 3, nearest the delivery end of the chute 19 of the apparatus 1 drops its tube first, and the next adjacent stack 4 of opposite orientation drops its tube next, and so on until the last tube to be dripped is the one falling from stack 8. At this point the tubes are allowed to move clear of the part of the chute 19 directly below the stacks 3–8 before the next tube-dispensing cycle. Suitable monitoring and control means may be provided in order to ensure that the chute 19 is clear before any tube-dispensing cycle begins.

Although the preferred embodiment of the invention has been described in terms of a device for dispensing winding tubes for textile spinning, it is expected that there will be many other applications for a device of this kind.

When incorporated in a multi-position textile spinner such as an open-end spinner, it is possible for the apparatus 1 to be incorporated in a door of a tube store of the multi-position machine so that the tubes can be loaded into the door while the door is open, and then once the door has been closed the tubes can remain in the apparatus 1 which will then be positioned directly overhead the chute 19 and can be automatically controlled to dispense tubes onto the chute 19 when further tubes are to be fed to a doffer robot.

Figure 3:
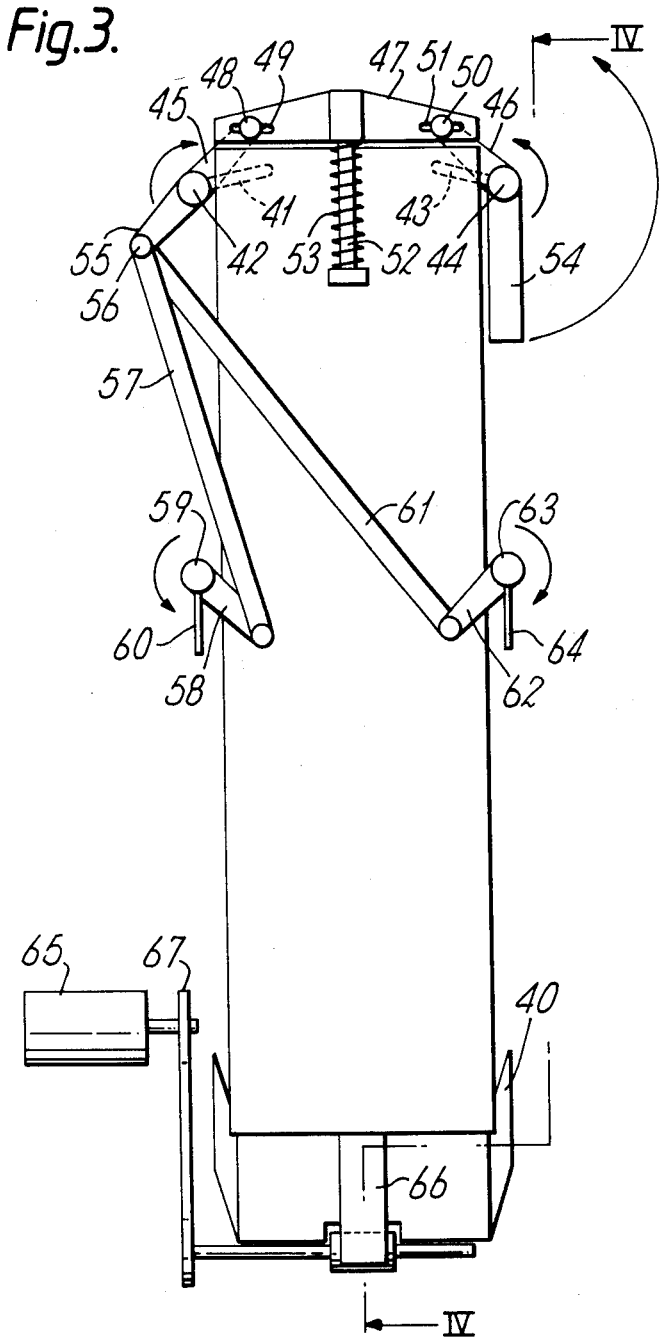
FIG. 3 is an end elevation of a second aspect of the device.
Figure 4:
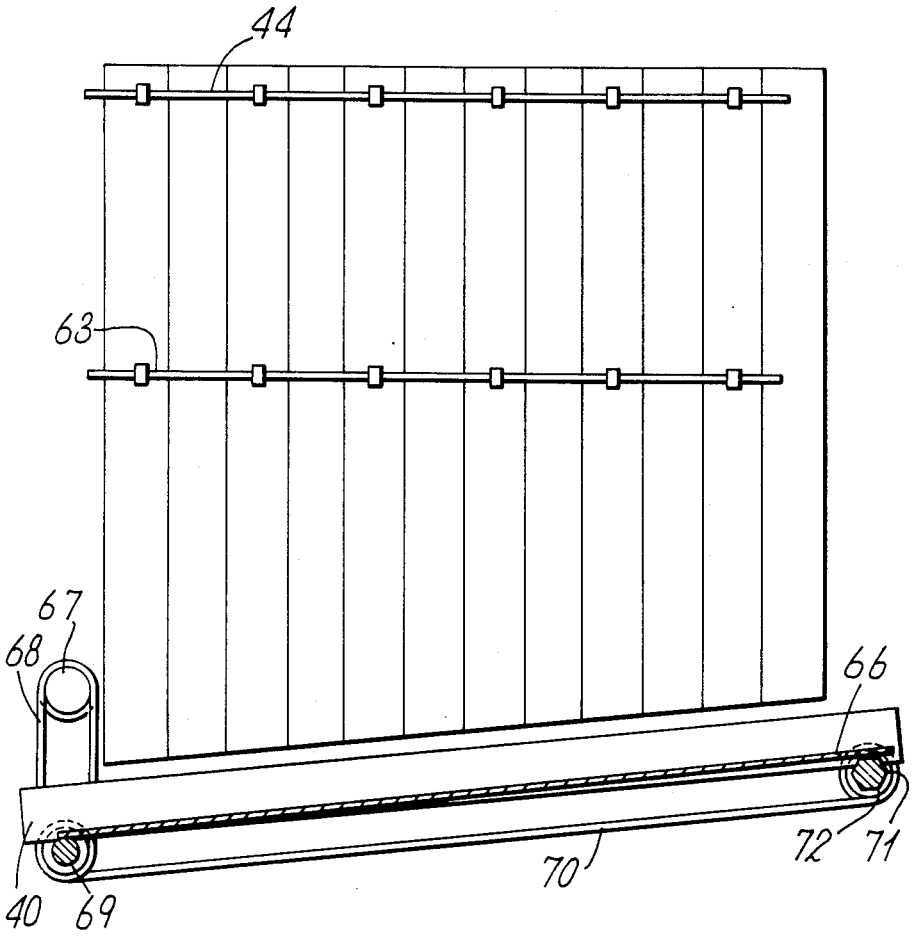
FIG. 4 is a side elevation of the device of FIG. 3 but with the lower part illustrated as a section on the line IV—IV of FIG. 3.

A second embodiment of the present invention is illustrated in FIGS. 3 and 4 in which FIG. 3 shows an end elevational, partly sectional view which illustrates drive linkage between the various cone retaining fingers corresponding to fingers 33 of FIG. 2, and additional retaining fingers which replace the brake plates 30 and 32 of FIG. 2.

The embodiment of FIGS. 3 and 4 also lacks the upstanding fin 23 shown in FIG. 2 and instead uses a joggling plate which can be better appreciated from FIG. 4.

FIG. 3 shows each of the upper retaining fingers 41 along the left hand side of the stack mounted on a common shaft 42, and each of the retaining fingers 43 at the right hand side of the stack mounted on a common shaft 44.

The shafts 42 and 44 have respective drive levers 45 and 46 joined to a cross head 47 at one end of the machine, the lever 45 of shaft 42 having a horizontally extending end 48 which rides in a horizontal slot 49 of the cross head 47 while the lever 46 of shaft 44 has a similar end portion 50 riding in a horizontal slot 51 of the cross head 47.

The cross head 47 is itself supported on a vertical bolt 52 and is biased upwardly by a helical compression spring 53. The arrangement is such that descent of the cross head 47 against the biasing of the spring 53 on the stationary bolt 52 will rotate shaft 42 in the clockwise direction and shaft 44 in the anticlockwise direction thereby retracting the various fingers 41 on shaft 42 and fingers 43 on shaft 44. This depression of the cross head 47 is achieved by means of an operating lever 54 mounted at one end of shaft 44 and able to be lifted by the operator in order to lower the various retaining fingers 41 and 43, simultaneously.

Rotation of the shaft 42 in the clockwise sense to lower its various fingers 41 will also result in clockwise rotation of an arm 55 at one end of the shaft 42, the arm 55 having its free end articulated at 56 to a link 57 which, through the agency of a crank 58, drives a shaft 59 for anti-clockwise rotation to introduce its retaining fingers 60 into the respective columns of the apparatus, and the articulartion 56 also effects driving to a link 61 which, through the agency of a crank 62, effects clockwise rotation of a shaft 63 to introduce its various rotating fingers 64 into the respective columns of the device.

It should be noted that when the upper retaining fingers 41 and 43 are all in their raised positions where they retain the top tube in the respective column (the FIG. 3 position), the lower retaining fingers 60 and 64 mid-way down the columns are in the retracted or lowered position where they have just released a cone retained thereon to allow it to join the other cones (not shown) at the bottom of the stack in the respective column.

It will be appreciated that the end elevation of FIG. 3 is taken from the left hand side of FIG. 4. In FIG. 3, for reasons of simplicity of illustration, the stack monitoring system 35 and 36 of FIG. 2 and the release cams 15 of FIG. 2 together with their associated drive linkage have all been omitted.

FIG. 3 also shows a drive motor 65 for a joggling plate 66 extending along the floor of the chute 40. The drive transmission to the joggling plate 66 is best illustrated in FIG. 4.

In FIG. 4, from which the linkage to the shafts 44 and 63, and the fingers on those shafts, have been omitted, there is shown the output pulley 67 of the motor 65 driving a belt 68 which also passes around a pulley 69 on a shaft at the lower end of the chute 40. A further drive belt 70 passes in a direction generally parallel to the floor of the chute 40 and around a further pulley 71 at the upper end of the chute 40. The shaft (not shown) fastened to the pulley 71 carries a hexagonal cam 72 on which the joggling bar 66 sits, the other end of the joggling bar 66 adjacent the downstream end of the chute 40 being suitably pivoted, for example by means of a loose fitting finger passing through the joggling bar 66 but anchored to the floor of the chute 40.

As will be readily appreciated, operation of the motor 65 results in rotation of the hexagonal cam 72 causing a joggling oscillation of the joggling bar 66, thereby unsticking any cones in the alternating orientation array of cones lying on the collecting surface defined by the floor of the chute 40, and hence promoting movement of those cones down the inclined chute.

We claim:

1. A device for dispensing conical objects, comprising at least two side-by-side stacks, each said stack having a cross-section defining a narrow end and a wide end which limits said conical objects to a non-vertical orientation, said stacks containing said conical objects in alternating and reverse orientations from one stack to the next so that the wide end of a first stack is adjacent the narrow end of the stack adjacent thereto; means defining a collecting surface beneath said stacks; means for releasing conical objects from said stacks wherein conical objects released from one stack land on said collecting surface adjacent to conical objects released from a next adjacent stack having the reverse orientation, and means to laterally move said conical objects along said collecting surface before release of the next conical objects in a sequence which follows from the first-released conical objects so that a delivered stream of said conical objects is produced in which said conical objects alternate and are reversed in their orientation.

2. Apparatus according to claim 1, wherein there are several said stacks of each orientation.

3. Apparatus according to claim 1, wherein said means of releasing conical objects from said stacks includes first conical object-releasing means near the bottom of said stacks said first conical object-releasing means being driven in sequence to release a bottom conical object of said stacks onto said collecting surface.

4. Apparatus according to claim 3, wherein said means for releasing conical objects from said stacks further includes second conical object-releasing means partway down said stacks to retain a conical object and to release it at a predetermined instant.

5. A device according to claim 1, wherein said collecting surface is a trough to accommodate said released conical objects disposed laterally thereon.

6. Apparatus according to claim 1, including means for monitoring each said stack to indicate when any one of said stacks has reached a given degree of depletion of its supply of said conical objects.

7. Apparatus according to claim 1, wherein the stacks permit free fall of the conical objects therein; and including braking means for arresting the free fall of a conical object in said stacks.

8. Apparatus according to claim 7 wherein said braking means is arranged to retard the wide end of a conical object falling in said stack.

9. Apparatus according to claim 7, including a retaining finger near a top of each said stack to hold up a conical object placed in said top of said stack and means operable to retract said retaining finger to release said placed conical object when desired.

10. Apparatus according to claim 9, wherein said braking means comprise a further retaining finger partway down each stack, and means for driving said further retaining finger for retaining a conical object during its descent down the stack and for releasing said retained concial object.

11. Apparatus according to claim 1, and including joggling means on said collecting surface for agitating the conical objects of said delivered stream to maintain movement of the conical objects along said collecting surface.

12. Apparatus according to claim 1, including a retaining finger near a top of each said stack to hold up a conical object placed in said top of said stack and means operable to retract said retaining finger to release said placed conical object when desired.

13. Apparatus according to claim 1, including means for retaining said conical objects in said stacks in an inclined orientation.

14. A device for dispensing conical objects, comprising at least two side side-by-side stacks, each said stack having a cross-section defining a narrow end and a wide end which limits said conical objects to a non-vertical orientation, said stacks containing conical objects having alternating and reverse orientations from one stack to the next so that the wide end of a first stack is adjacent the narrow end of the stack adjacent thereto; means defining a collecting surface beneath said stacks; conical object-releasing means for releasing conical objects from said stacks wherein conical objects relesed from one stack land on said collecting surface adjacent conical objects released from a next adjacent stack having reverse orientation; and means to laterally move said conical objects along said collecting surface in a sequential stream of conical objects in which said conical objects alternate and are reversed in their orientation; and means for maintaining the orientation and lateral movment of said concial objects along said collecting surface.

15. The device of claim 14 including means for maintaining the axis of said conical objects generally horizontal while moving said objects laterally along said collecting surface.

* * * * *